US006540271B1

(12) United States Patent
Kalsi

(10) Patent No.: US 6,540,271 B1
(45) Date of Patent: Apr. 1, 2003

(54) VEHICLE DOOR LATCH

(75) Inventor: Gurbunder Singh Kalsi, Oldbury (GB)

(73) Assignee: Meritor Light Vehicle Systems (UK) Limited (GB)

( * ) Notice: Subject to any disclaimer, the term of this patent is extended or adjusted under 35 U.S.C. 154(b) by 0 days.

(21) Appl. No.: 09/743,424

(22) PCT Filed: Jul. 1, 1999

(86) PCT No.: PCT/GB99/02092

§ 371 (c)(1),
(2), (4) Date: Mar. 12, 2001

(87) PCT Pub. No.: WO00/04262

PCT Pub. Date: Jan. 27, 2000

(30) Foreign Application Priority Data

Jul. 15, 1998 (GB) ..... 9815374

(51) Int. Cl.[7] ..... E05C 3/06
(52) U.S. Cl. ..... 292/216; 292/DIG. 23
(58) Field of Search ..... 292/216, 201, 292/DIG. 23; 49/279, 280; 70/264

(56) References Cited

U.S. PATENT DOCUMENTS

| | | | | | |
|---|---|---|---|---|---|
| 5,180,198 | A | * | 1/1993 | Nakamura | 292/201 |
| 5,232,253 | A | * | 8/1993 | Tamiya | 292/201 |
| 5,433,496 | A | * | 7/1995 | Zimmermann | 292/201 |
| 5,494,322 | A | * | 2/1996 | Menke | 292/216 |
| 5,520,425 | A | * | 5/1996 | Dowling | 292/201 |
| 5,676,003 | A | * | 10/1997 | Ursel | 70/472 |

FOREIGN PATENT DOCUMENTS

| | | |
|---|---|---|
| DE | 19505779 | 8/1996 |
| EP | 0106725 | 4/1984 |
| EP | 0812972 | 12/1997 |
| GB | 97 10602.5 | 2/1999 |

OTHER PUBLICATIONS

International Search Report.

* cited by examiner

*Primary Examiner*—Gary Estremsky
(74) *Attorney, Agent, or Firm*—Carlson, Gaskey & Olds

(57) ABSTRACT

A vehicle door latch assembly including a pivotally mounted latch claw (10) having a mouth operatively co-acting with a striker as the door nears its closed position, a latching pawl (16) self-engaging with the claw to hold it in a latched condition retaining the door, and unlatching means selectively operable to disengage the latching pawl for opening the door: characterised in that the unlatching means comprises a pawl lifter (20) movable from a position of rest to carry the latching pawl out of engagement with the claw, a power output member (24) movable to engage and displace the pawl lifter from said position of rest, an input member (30) power actuated between first and second positions, clutch means (28,32) releasably drive connecting the input member to the output member to cause shifting of the latter as the input member moves to its second position, and an overriding element (36) carrying the clutch means into and out of drive connection, said overriding element being operatively coupled to the pawl to ensure that manual operation of the pawl lifter is not obstructed by failure or malfunction of power actuation of the input member.

16 Claims, 3 Drawing Sheets

VEHICLE DOOR LATCH

BACKGROUND OF THE INVENTION

This invention relates to latches for vehicle doors, particularly for light passenger and goods vehicles.

Powered locking and powered latching of doors is becoming more favored, both as part of central locking systems and to enable more effective weathersealing of doors and greater freedom in styling and design. There are advantages in providing for power actuated unlatching of doors. For one, much of the mechanical linkage and components needed for conventional manual inside and outside door handles can be dispensed. Additionally, unitary lock and latch modules of standard form can be speedily installed in doors of a wide range of vehicle models and types without special adaptation.

SUMMARY OF THE INVENTION

The object of the invention is to provide improvements in vehicle door latch assemblies, in particular the provision of latches having a power unlatching facility in an economical, effective and reliable form.

According to the invention, there is provided a vehicle door latch assembly including a pivotally mounted latch claw having a mouth operatively co-acting with a striker as the door nears its closed position, a latching pawl self-engaging with the claw to hold it in a latched condition retaining the door, and unlatching means selectively operable to disengage the latching pawl for opening the door. The unlatching means comprise a pawl lifter movable from a position of rest to carry the latching pawl out of engagement with the claw, a power output member movable to engage and displace the pawl lifter from said position of rest, an input member power actuated between first and second positions, clutch means releasably drive connecting the input member to the output member to cause shifting of the output member as the input member moves to its second position, and an overriding element carrying the clutch means into and out of drive connection. The overriding element is operatively coupled to the pawl to ensure that manual operation of the pawl lifter is not obstructed by failure or malfunction of power actuation of the input member.

Preferably a cam surface of the claw acts on the pawl when the claw is in the open position to operatively couple the overriding element and pawl.

According to a further aspect of the present invention, the overriding element includes a surface acting in co-operation with a surface of the claw to ensure that manual operation of the pawl lifter is not obstructed by failure or malfunction of power actuation of the input member.

The output member is conveniently a power release lever having an arm positioned for engagement with the pawl lifter and a second arm provided with a drive formation forming a first element of the clutch means.

The input member may be a crank element coupled to an electric or other power actuator for angular movement and carrying a drive formation forming a second element of the clutch means, the pivot of the crank element being carried on the overriding element which is shifted on manual operation of the release means to move the crank element in a direction disengaging said drive formations of the clutch means.

BRIEF DESCRIPTION OF THE DRAWINGS

An example of the invention is now more particularly described with reference to the accompanying drawings in which.

DETAILED DESCRIPTION OF THE PREFERRED EMBODIMENT

Figure 1:
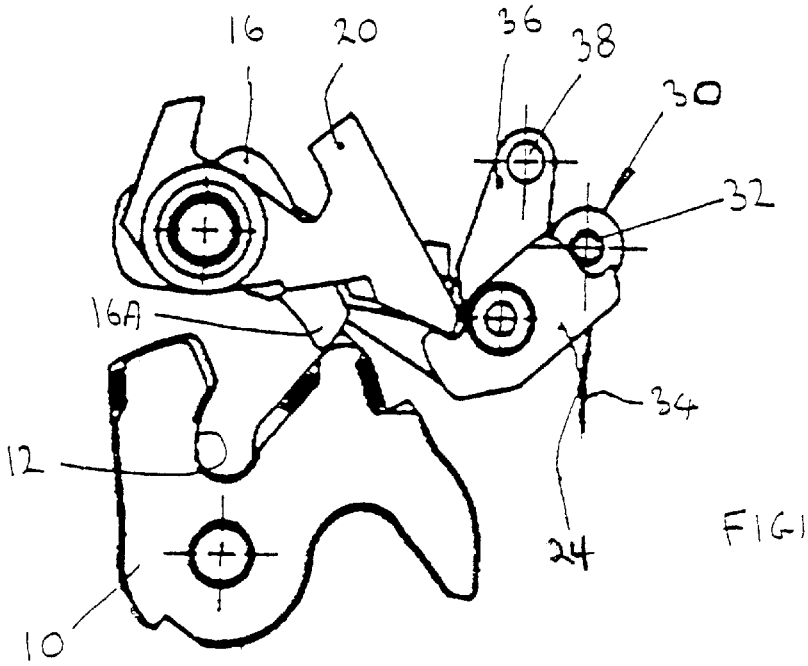
FIG. 1 is a diagram of power unlatching parts of a vehicle door latch assembly in an engaged rest position with some parts not relevant to the invention removed for clarity.

Referring first to FIG. 1, the latch assembly, which will be operatively secured in a door in a known manner, includes a conventional rotating latch claw having a mouth 12 for contacting with a striker operatively mounted to the associated door post. Claw 10 is biased by a claw spring in a counter-clockwise direction. A pawl-tooth 16A of a latching pawl 16 self engages with the claw 10 in a known manner to retain the claw 10, and hence the door, releaseably at a first safety position when the door is near closed, and an inner position shown in FIG. 1 when the door is fully shut.

The assembly may include powered closing/latching of the door.

The unlatching means includes a pawl lifter 20 in the form of a lever pivoted co-axially with pawl 16 which engages the pawl 16 when angularly displaced from its position of rest as shown in FIG. 1, so causing disengagzement of pawl 16 from claw 10 to free the door for opening. Manually operable release means acts on arm 20A of pawl lifter 20 via a lock link to rotate pawl lifter 20 to unlatch the door.

Figure 4:
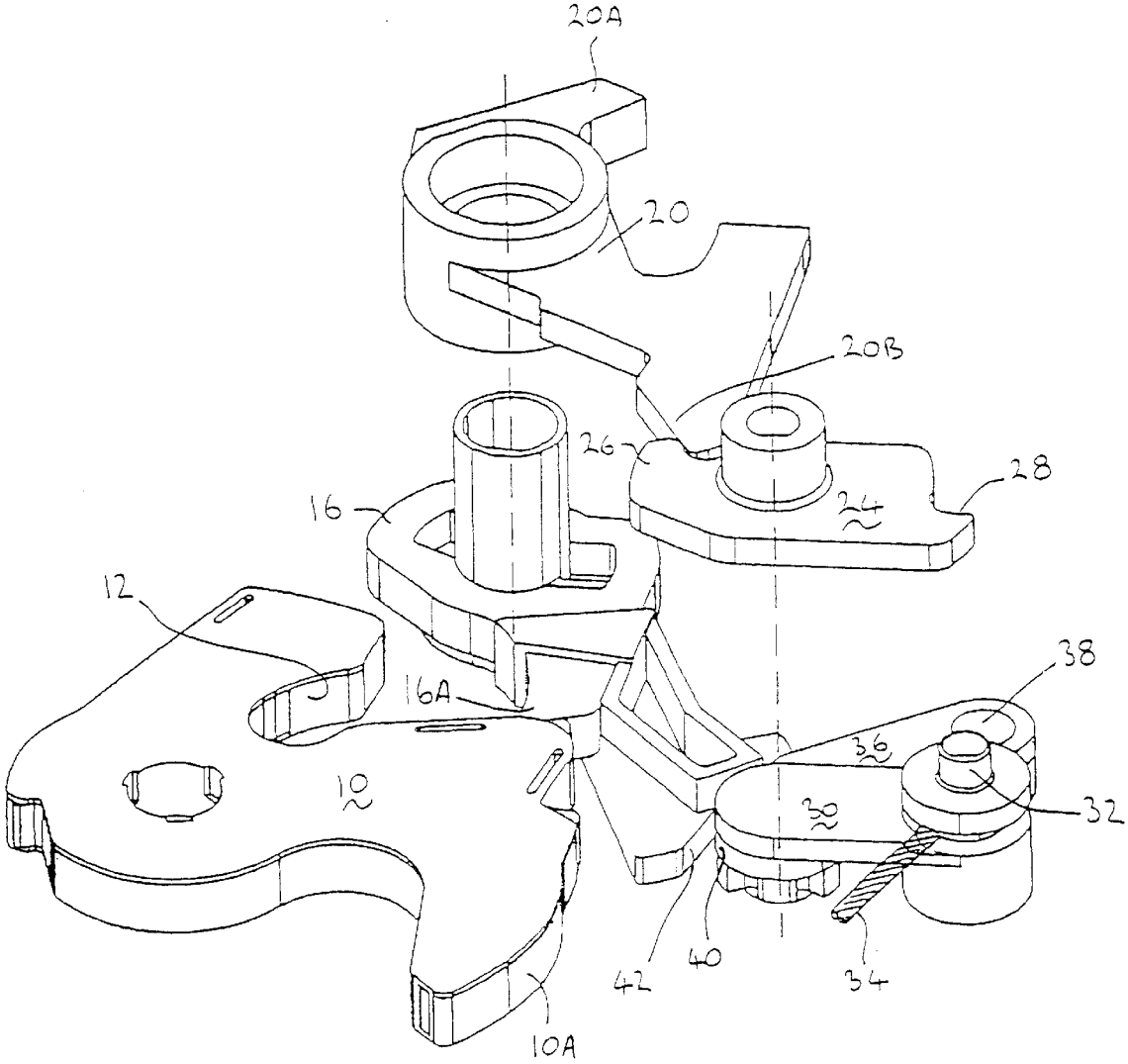
FIG. 4 is a perspective view of the vehicle door latch assembly of FIG. 1.

An output member in the form of a power release lever 24, best illustrated in FIG. 4, is fulcrummed on a fixed pivot whose axis is parallel to the claw axis. Its left-hand arm 26 is positioned to engage the lower face of a righrward extension 20B of pawl lifter 20 so that when it is turned clockwise it displaces lifter 20 and so causes disengagement of pawl 16 independently of the manually operable release means. The right hand arm of lever 24 terminates in a drive formation in the form of a shoulder 28.

An input member in the form of a crank 30 includes a drive pin 32. The crank 30 extends alongside the righthand arm of the lever 24 and is engageable with the shoulder 28. Clockwise angular movement of the crank 30 is transmitted to the level 24. An electric actuator motor is coupled to the crank 30 by a vertical power drive line 34, selectively operable to power crank 30.

Figure 2:
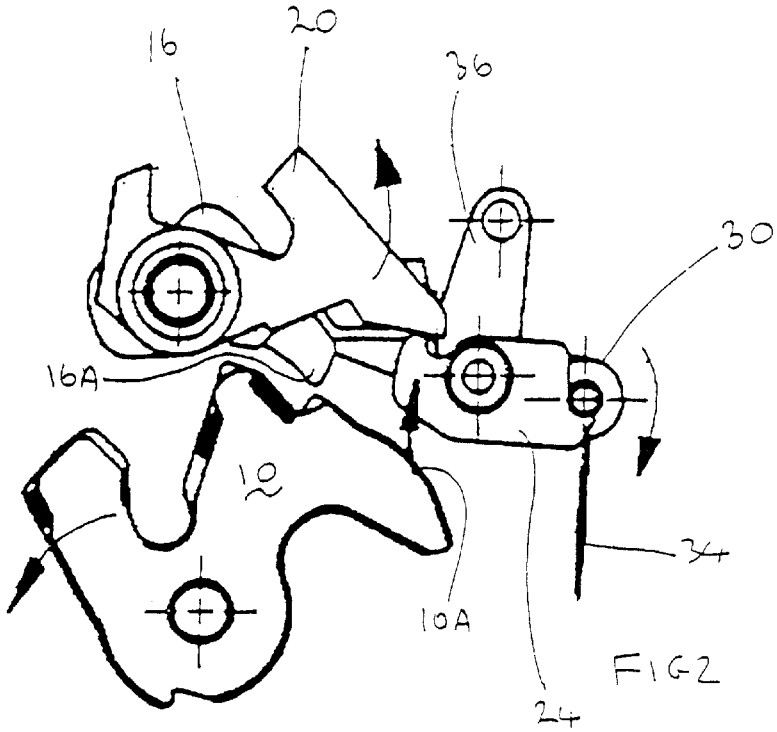
FIG. 2 is a like diagram showing the parts during a power unlatching operation.

Crank 30 is pivoted on the lower end of a swinging overriding element 36, the upper end of which is mounted on a fixed pivot 38 in spaced parallel relationship to the axis of release lever 24. In the angular position shown in FIGS. 1, 2 and 4 the pivot axes of crank 30 and lever 24 are substantially co-incident, so maintaining the clutch means constituted by shoulder 28 and pin 32 in drive engagement.

The lower end of element 36 includes a camming formation 40 (FIG. 4) which co-acts with a ramp 42 on the pawl 16. If there is any malfunction of the power unlatching actuator or associated parts, e.g. due to a flat battery or the actuator jamming in an open, closed or intermediate position, which might block the latching/unlatching functions, operation of the manually operable release means will result in counterclockwise rotation of pawl 16, causing ramp 42 to push formation 40 to the right. This displaces crank 30 to the right in relation to release lever 24, declutching pin 32 from shoulder 28 and freeing the release lever 24 so that it cannot interfere with actuation of pawl lifter 20 by means of the manual operable release means.

Figure 3:
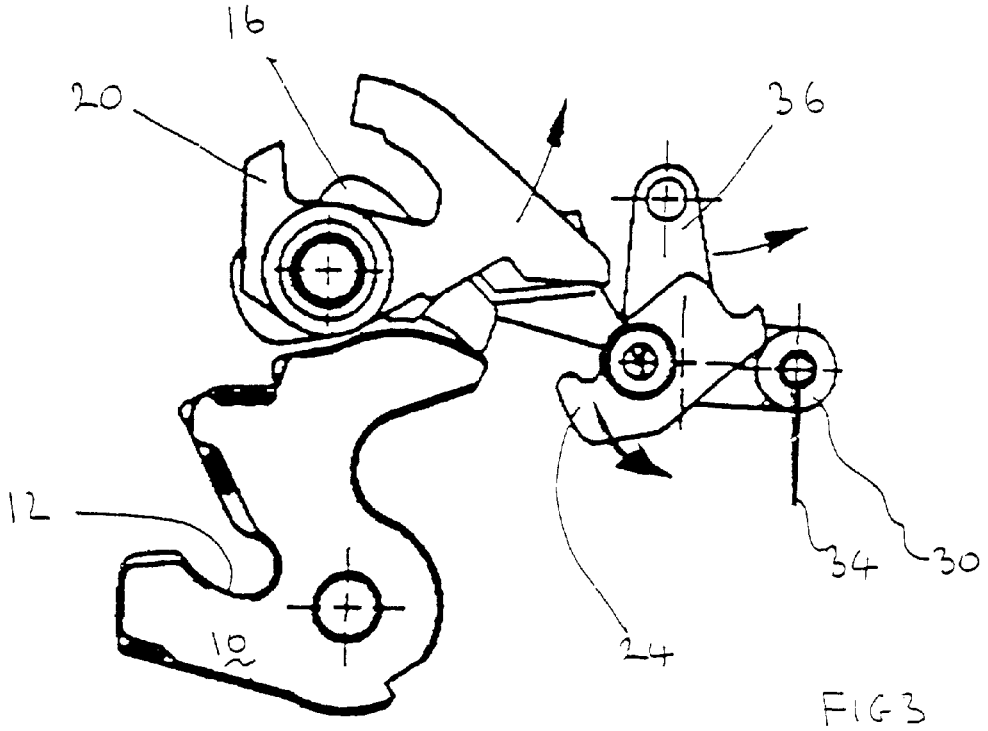
FIG. 3 is a like diagram with the parts in a power open position.

A release lever spring on release lever 24 provides a force urging counterclockwise rotation of release lever 24 relative to overriding element 36 to return the release lever 24 to the position shown in FIG. 3.

A spring on overriding element 36 provides a restoring force urging re-engagement of pin 32 and shoulder 28 when power actuation is restored or reset.

FIG. 1 shows the latch in a closed position. Movement of the drive link 34 vertically downwards causes clockwise rotation of release lever 24 and counterclockwise rotation of pawl lifter 20 from an engaged position (see FIG. 1) to a first release position (see FIG. 2) resulting in the pawl 16 disengaging the claw notch.

The claw spring then rotates the claw 10 counterclockwise to an open position (see FIG. 3) wherein a cam surface 10A of claw 10 contacts the pawl tooth 16A to rotate the pawl 16 further counter-clockwise to a second release position (see FIG. 3). When the pawl 16 moves from the first release position, to the second release position the ramp 42 pushes formation 40 to the right to disengage pin 32 from shoulder 28, wherein release lever 24 returns to its rest position under the action of the release lever spring. Thus, even if the power actuator then malfunctions and remains in its release position as shown in FIG. 3, the door can still subsequently be correctly latched with full engagement of the pawl tooth 16A with the claw notch and also manually unlatched.

It should be noted that release of the clutch means is effected independently of the manually operable release means.

Also when the claw 10 is moved to its open position (either by manual or power release) the release lever 24 will return to its rest position (see FIG. 3) independently from the subsequent operation of the manually operable release means or the power actuator.

Thus manual operation of both door latching and unlatching is ensured regardless of any failure or malfunction of the power unlatching eg the power unlatching mechanism remaining in a latched, unlatched or intermediate condition.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A vehicle door latch assembly comprising:

a pivotally mounted latch claw having a mouth operatively co-acting with a striker as a vehicle door nears a closed position;

a pawl self-engaging said claw to hold said claw in a latched condition retaining said door; and an unlatching mechanism selectively operable to disengage said pawl to open said door, said unlatching mechanism including:

a pawl lifter movable from a rest position to carry said pawl out of engagement with said claw, an output member movable to engage and displace said pawl lifter from said rest position, an input member actuatable by a power actuator between a first position and a second position, said input member being releaseably drive connected to said output member to cause shifting of said output member as said input member moves to said second position, and an overriding element connected to said input member to move said input member and said output member into and out of drive connection and being operatively coupled to said pawl to maintain manual operability of said pawl lifter if the power actuator fails to actuate the input member.

2. The latch assembly as recited in claim 1 wherein said output member is a power release lever mounted by a first pivot and includes a first arm position for engagement with said pawl lifter and a second arm provided with an output drive formation releaseably connected to said input member.

3. The latch assembly as recited in claim 1 wherein said input member is a crank element mounted by a second pivot and includes an arm provided with an input drive formation releaseably connected to said output member.

4. The latch assembly as recited in claim 1 wherein said output member is a power release lever mounted by a first pivot and includes a first arm position for engagement with said pawl lifter and a second arm provided with an output drive formation releaseably connected to said input member, and said input member is a crank element mounted by a second pivot and includes an arm provided with an input drive formation releaseably connected to said output member.

5. The latch assembly as defined in claim 4 wherein said second arm of said release lever and said arm of said crank element are in generally face to face relationship, and said input drive formation and said output drive formation co-act.

6. The latch assembly as recited in claim 4 wherein said input drive formation is a pin and said output drive formation is a notch.

7. The latch assembly as recited in claim 4 wherein said output drive formation is a pin and said input drive formation is a notch.

8. The latch assembly as recited in claim 4 wherein said second pivot is displaceable to shift said crank element to engage and disengage said input drive formation and said output drive formation.

9. The latch assembly as recited in claim 4 wherein said second pivot is mounted on said overriding element.

10. The latch assembly as recited in claim 4 wherein said overriding element is a link mounted by a third pivot.

11. The latch assembly as recited in claim 4 wherein said overriding element is shifted on manual operation of said unlatching mechanism to move said crank element in a direction disengaging said input drive formation and said output drive formation.

12. The latch assembly as recited in claim 4 wherein said overriding element is operatively acted on by said pawl through a camming formation on said overriding element.

13. The latch assembly as recited in claim 4 wherein said overriding element is operatively acted on by said pawl through a camming formation on a portion of said pawl contacted by said overriding element.

14. The latch assembly as recited in claim 4 wherein said overriding element is resiliently biased to engage said input drive formation and said output drive formation.

15. The latch assembly as recited in claim 1 wherein said claw includes a cam surface which acts on said pawl when said claw is in said open position to operatively couple said overriding element and said pawl.

16. A vehicle door latch assembly including:

a pivotally mounted latch claw having a mouth operatively co-acting with a striker as a vehicle door nears a closed position;

a latching pawl self-engaging said claw to hold said claw in a latched condition retaining said door; and an unlatching mechanism selectively operable to disengage said pawl to open said door including:

a pawl lifter movable from a rest position to carry said pawl out of engagement with said claw, an output member movable to engage and displace said pawl lifter from said rest position, an input member actuatable by a power actuator between a first position and a second position, said input member being releaseably drive connected to said output member to cause shifting of said output member as said input member moves to said second position, and an overriding element connected to said input member to move said input member and said output member into and out of drive connection including a surface acting in co-operation with a surface of said claw to maintain manual operability of said pawl lifter if the power actuator fails to actuate said input member.

* * * * *